US009797278B2

(12) United States Patent
Flender et al.

(10) Patent No.: US 9,797,278 B2
(45) Date of Patent: Oct. 24, 2017

(54) CAMSHAFT

(71) Applicant: Mahle International GmbH, Stuttgart (DE)

(72) Inventors: Thomas Flender, Eberdingen (DE); Alf Heydenblut, Hinternah (DE); Michael Kreisig, Stuttgart (DE); Andre Maeder, Hildburghausen (DE); Antonio Menonna, Ditzingen (DE); Juergen Rommel, Burgstetten (DE); Stefan Steichele, Gerlingen (DE); Christoph Steinmetz, Ludwigsburg (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/301,400

(22) PCT Filed: Mar. 25, 2015

(86) PCT No.: PCT/EP2015/056330
§ 371 (c)(1),
(2) Date: Oct. 2, 2016

(87) PCT Pub. No.: WO2015/150175
PCT Pub. Date: Oct. 8, 2015

(65) Prior Publication Data

US 2017/0107867 A1 Apr. 20, 2017

(30) Foreign Application Priority Data

Apr. 2, 2014 (DE) ..... 10 2014 206 291

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 1/34413* (2013.01); *F01L 2001/0473* (2013.01)

(58) Field of Classification Search
CPC ..... F01L 1/34; F01L 1/047; F01L 1/34413; F01L 1/3442; F01L 2001/0473
(Continued)

(56) References Cited

U.S. PATENT DOCUMENTS 7,739,987 B2 * 6/2010 Hoshikawa ..... F01L 1/34 123/90.16
8,201,528 B2 6/2012 Knecht et al.
(Continued)

FOREIGN PATENT DOCUMENTS

DE 102008031120 A1 5/2009
DE 102008033230 A1 7/2009
(Continued)

OTHER PUBLICATIONS

English abstract for DE-102012105284.
(Continued)

*Primary Examiner* — Ching Chang
(74) *Attorney, Agent, or Firm* — Fishman Stewart PLLC

(57) ABSTRACT

An adjustable camshaft may include an inner shaft and an outer shaft arranged coaxially thereto. The camshaft may also include a camshaft adjuster having a stator connected to the outer shaft in a torque-proof manner, and a rotor connected to the inner shaft. The camshaft may further include an integral first connection contour provided at an end of the inner shaft, and an integral second connection contour complementary to the integral first connection contour and provided on the rotor. The connection contours may directly or indirectly enable an interlocking connection between the inner shaft and the rotor.

20 Claims, 3 Drawing Sheets

(58) Field of Classification Search
USPC ..... 123/90.16, 90.6, 90.15, 90.17
See application file for complete search history.

(56) References Cited

U.S. PATENT DOCUMENTS

| | | | |
|---|---|---|---|
| 8,336,512 | B2 | 12/2012 | Myers et al. |
| 2014/0216201 | A1 | 8/2014 | Kunz et al. |

FOREIGN PATENT DOCUMENTS

| | | | |
|---|---|---|---|
| DE | 102009041768 | A1 | 4/2010 |
| DE | 202008018146 | U1 | 12/2011 |
| DE | 102011052822 | A1 | 2/2013 |
| DE | 102011086236 | A1 | 5/2013 |
| DE | 102012105284 | A1 | 12/2013 |
| EP | 2527607 | A2 | 11/2012 |
| GB | 2424258 | A | 9/2006 |
| JP | H01227809 | A | 9/1989 |
| JP | 2010502884 | A | 1/2010 |
| JP | 2010190159 | A | 9/2010 |
| JP | 2011169313 | A | 9/2011 |
| JP | 2012111457 | A | 6/2012 |
| JP | 2013249865 | A | 12/2013 |

OTHER PUBLICATIONS

English abstract for DE-202008018146.
English abstract for EP-2527607.
English abstract for DE-102008031120.
English abstract for DE-102011086236.
Translation of Office Action for Japanese Application No. 2016-558345, dated Feb. 17, 2017.

* cited by examiner

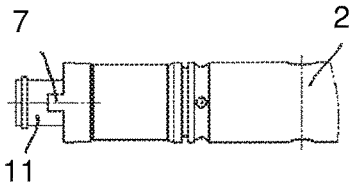
FIG. 4A
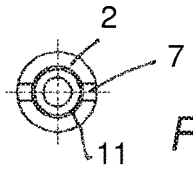
FIG. 4B
FIG. 4C
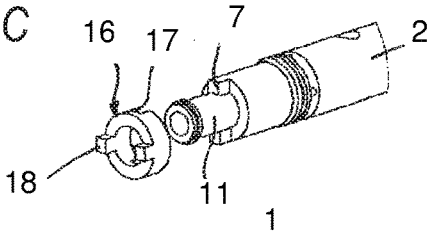
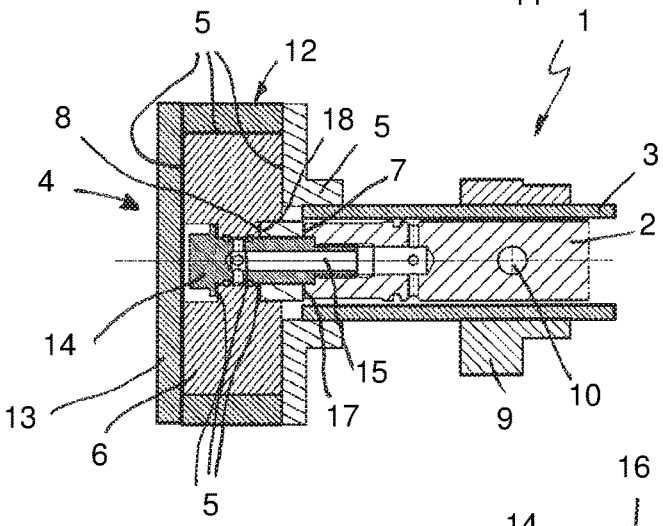
FIG. 5
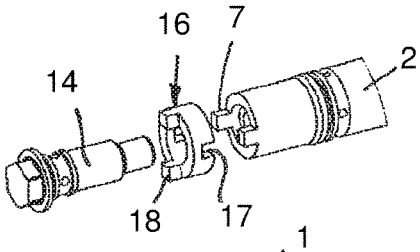
FIG. 6
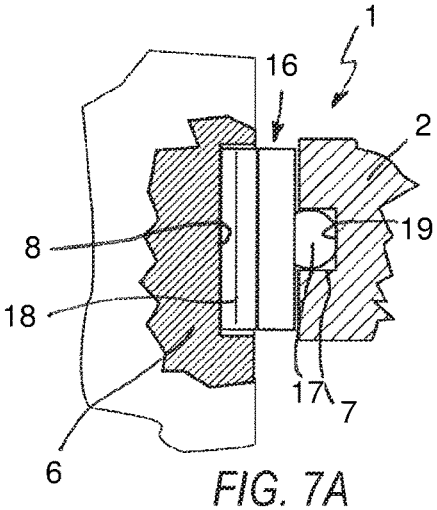
FIG. 7A
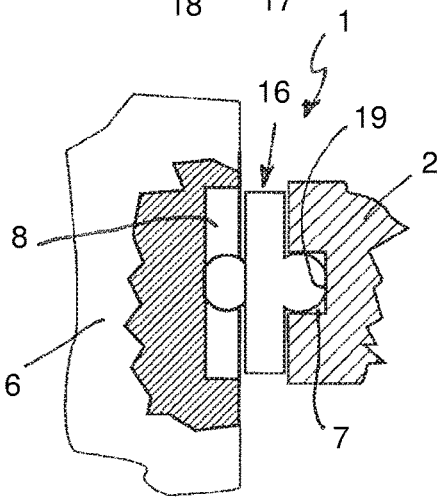
FIG. 7B

CAMSHAFT

CROSS REFERENCE TO RELATED APPLICATIONS

This application claims priority to German Patent Application No. DE 10 2014 206 291.8, filed on Apr. 2, 2014, and International Patent Application No. PCT/EP2015/056330, filed on Mar. 25, 2015, both of which are hereby incorporated by reference in their entireties.

TECHNICAL FIELD

The present invention relates to an adjustable camshaft having an inner shaft and an outer shaft arranged coaxially.

BACKGROUND

The connection of a single-acting camshaft adjuster (phase adjuster) for adjusting an inner shaft against an outer shaft on a cam-in-cam camshaft generally takes place by a stator securely joined onto the outer shaft and by a rotor screwed to the inner shaft and securely connected therewith. The stator is driven by the crankshaft via a chain/gear/belt wheel, so that the flux of force takes place onto the outer shaft. The inner shaft can be adjusted here in a "force-free" manner (not against the drive torque). The tolerances between rotor and stator are selected so as to be very tight, so that the inner leakage in hydraulically actuated camshaft adjusters and therefore also a loss of efficiency can be minimized. With a simple phase adjuster on a conventional camshaft, a portion of the camshaft adjuster floats, which means the stator against the rotor, whereby a tolerance compensation always exists for faults in assembly or manufacture. In particular, it is not necessary for the rotor to be caulked against the stator.

In adjustable camshafts, the stator of the camshaft adjuster is usually shrunk/glued/welded onto the outer shaft, whereas the rotor of the camshaft adjuster is screwed against the end-side axial plane face of the inner shaft. As inaccuracies can occur in the manufacture and assembly of the inner shaft (e.g. pinned fitting, tolerance chains), it can occur in the case of such a rigid assembly of the rotor on the inner shaft that the rotor is installed in a tilted manner against the stator, and thus a contact, up to the point of a complete jamming, can occur. In this case, the inner shaft can no longer be rotated against the outer shaft.

In order to be able to be able to create a compensation here, compensation elements present themselves, which can compensate an at least certain defective position.

From DE 10 2012 105 284 A1 a generic camshaft is known, having a camshaft adjuster for adjusting the inner camshaft and/or the outer camshaft and with a compensation element arranged between the inner camshaft and the outer camshaft on the one hand and the cam adjuster on the other hand. This compensation element has a disc-like shape, in order to improve the camshaft structurally and/or functionally. The torque transmission, however, takes place purely in a frictionally engaged manner.

From DE 10 2008 033 230 B4 a double camshaft adjuster in layer construction is known for controlling a double camshaft, with a first rotor-like driven body and a second rotor-like driven body, which are arranged parallel to one other with their rotor body parts. Here, each driven body is intended for receiving at least one camshaft of the double camshaft, leading out laterally from the camshaft adjuster centre. For the alignment at least of one driven body to the double camshaft, furthermore a compensation element is provided, which is a movement member creating a degree of freedom and permits a deflection of the surrounding driven body with respect to the double camshaft.

From DE 20 2008 018 146 U1 an arrangement is known for camshaft adjustment, which comprises a camshaft adjuster which has at least one drive wheel, a rotor, a stator with a stator housing and a camshaft with cams, and an oil feed to the camshaft adjuster. The camshaft adjuster is held with a rotor, the internal diameter of which is smaller than a cam-surrounding circle, in an interlocking- and/or force-fitting manner on an end of a camshaft, wherein the camshaft has a hollow formation to receive a connection element having openings for the oil feed, such that the connection element is held in the hollow formation of the camshaft in an interlocking- and/or force-fitting manner. Either the connection element or the rotor have at least one carrier for the interlocking connection of the rotor with the camshaft and of the connection element, wherein this carrier is guided in a projecting manner through at least one opening in a hollow end of the camshaft. Hereby, a compact arrangement for camshaft adjustment is to be created.

SUMMARY

The present invention is concerned with the problem of indicating for an adjustable camshaft of the generic type an improved or at least an alternative embodiment, which in particular enables an improved tolerance compensation in the connecting of a rotor to the inner shaft.

This problem is solved according to the invention by the subject of the independent claims. Advantageous embodiments are the subject of the dependent claims.

The present invention is based on the general idea, in the case of an adjustable camshaft with an inner shaft and with an outer shaft arranged coaxially thereto, to connect with one another a rotor of a camshaft adjuster with the inner shaft of the adjustable camshaft in an interlocking manner, in particular via an Oldham coupling, wherein this Oldham coupling is configured singly or acting according to the Oldham principle. The stator of the camshaft adjuster is connected here securely with the outer shaft, whereas the rotor is screwed to the inner shaft. According to the invention, an integral first connection contour is provided at the end of the inner shaft and an integral second connection contour, which is complementary to the first connection contour, is provided on the rotor, these connection contours directly (single-acting Oldham coupling) or indirectly (double-acting Oldham coupling) making an interlocking connection between the inner shaft and the rotor and, if necessary, a tolerance compensation possible. The rotor can be formed for example as a sintered part, wherein the second connection contour is formed integrally on the rotor and thereby is produced together therewith. In the same manner, the first connection contour is formed integrally on the end face of the inner shaft, so that in the simplest case a direct engaging of the two connection contours into one another makes possible the desired interlocking connection in the form of a single-acting Oldham coupling (in one direction). Through the interlocking connection, a torque transmission which is free of play can be guaranteed, but on the other hand it is also possible to compensate at least minor dimensional and/or manufacturing tolerances, without complex compensation elements being necessary for this.

Expediently, the first connection contour is configured as a tongue and the second connection contour is configured as a groove, configured in a complementary manner thereto, so that the first connection contour and the second connection contour together form a single-acting Oldham coupling.

In a particularly expedient variant, the tongue and the groove are aligned parallel to a pin connecting a first cam with the inner shaft. Through the parallelity between the groove and the pin connecting the first cam with the inner shaft, it is possible to be able to compensate the faults which are expected in this direction. As in this case the inner shaft engages directly with its connection contour into the connection contour on the rotor, an intermediate piece can be dispensed with, wherein, however, a tolerance compensation is also only possible in one direction.

In an advantageous further development of the solution according to the invention, the first and/or the second connection contour is configured so as to be dome-shaped. Such a dome-shaped configuration enables a compensation of angular tolerances between the axis of the rotor of the camshaft adjuster and the axis of the inner shaft. Hereby, a further tolerance compensation is possible in this case with respect to angular deviations, without having to accept compromises in the torque transmission. Through an integral forming of the connection contour in the rotor or respectively on the inner shaft, an additional intermediate piece can be dispensed with.

In a further advantageous embodiment of the solution according to the invention, an intermediate piece is arranged between the inner shaft and the rotor, which intermediate piece is configured such that together with the first and second connection contour on the end face of the inner shaft or respectively on the rotor it forms an Oldham coupling. Such an Oldham coupling enables a tolerance compensation between the axis of the rotor and the axis of the inner shaft, in so far as these are arranged axially parallel to one another. In addition, it is conceivable that connection contours on the intermediate piece and/or the first connection contour on the inner shaft and/or the second connection contour on the rotor are formed as a rounded tongue or as a rounded-out groove, whereby in addition to the compensation of tolerances owing to an axial deviation between the axis of the inner shaft and the axis of the rotor, angular deviations with regard to these two axes are also able to be compensated. Furthermore, it is possible, with the use of an Oldham coupling, to mount the rotor in a floating manner, wherein in this case the inner shaft must be additionally mounted axially. Of course, an axial bearing of the inner shaft via the rotor of the camshaft adjuster is also possible. The inner shaft can be mounted radially via the pinned fitting.

In a further advantageous embodiment of the solution according to the invention, at least one connection contour, configured as a rounded tongue, has a plane face at the tongue head. When the tongues of the Oldham coupling are therefore configured spherically or respectively in a bar-like manner with a slightly flatly milled head, and the two parts are screwed to one another, these still have at least a slight play in order to enable a tolerance compensation, although the rotor is screwed to the inner shaft via the Oldham coupling. Thus, the rotor is secured to the inner shaft axially, a slight tilting of the rotor to the inner shaft in order to compensate tolerances still, however, being possible. This is due in particular to the fact that the inner shaft only has to be adjusted over a limited angle range of less than 180° against the outer shaft. Thus, by a slight tilting, a sufficient tolerance compensation can be achieved especially for the limited adjustment range of the rotor.

A further advantageous embodiment uses an intermediate piece arranged between the inner shaft and the rotor, which intermediate piece is configured such that together with the first and second connection contour on the end face of the inner shaft or respectively on the rotor it forms an Oldham coupling and has simply configured tongues, which engage with a little play into the complementary groove, and/or has rounded tongues. In addition, in this embodiment, at least one of the axial separation faces between rotor and intermediate piece or respectively intermediate piece and inner shaft is configured so as to be dome-shaped. Through this additional degree of freedom of the rotor against the inner shaft, an even more precise tolerance compensation can be achieved with simultaneous ideal transmission of force through the interlocking torque-proof connection between the rotor and the inner shaft.

Expediently, at least one of the connection contours is coated, in particular with an elastomer material. For the purpose of damping effect and further tolerance compensation, it is therefore possible to coat the intermediate piece or respectively corresponding contact surfaces and/or connection contours with a damping material, which in particular has a positive effect on the quiet running of an internal combustion engine equipped with such a camshaft.

In addition, it is conceivable to produce the intermediate piece partly or completely from an elastomer or respectively plastic. Hereby, an even greater damping effect could be achieved. An intermediate piece configured in such a way would, however, have to be designed accordingly in order to transfer the forces and torques occurring during operation.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are represented in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 2:
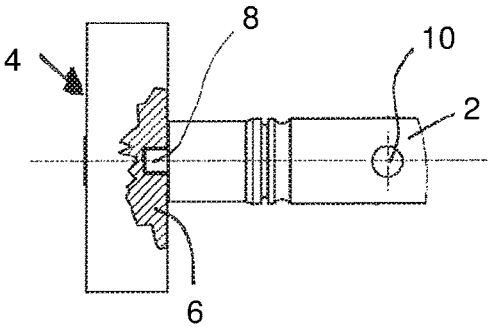
Figure 3:
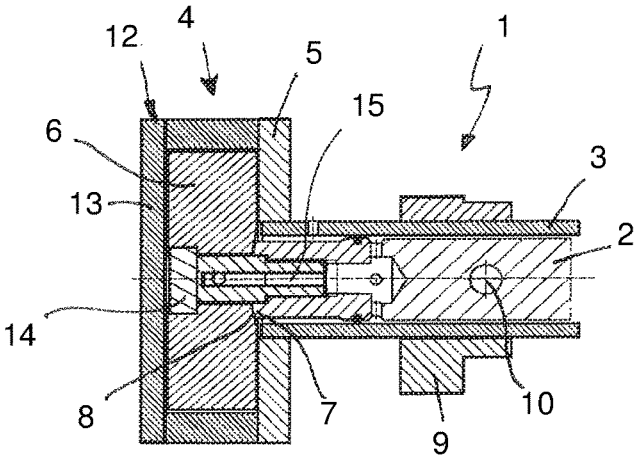

According to FIGS. 1, 3 and 5, an adjustable camshaft 1 according to the invention has an inner shaft 2 and an outer shaft 3 arranged coaxially thereto. Furthermore, a camshaft adjuster 4 (phase adjuster) is provided, the stator 5 of which is securely connected with the outer shaft 3 and the rotor 6 of which is screwed to the inner shaft 2. The rotor 6 here can be glued, welded or shrunk onto the outer shaft 3. According to the invention, at the end of the inner shaft 2 a first connection contour 7, formed integrally therewith, and on the rotor 6 an integral second connection contour 8, formed in a complementary manner to the first connection contour, are provided, which directly (cf. FIG. 1 to 3) or indirectly (cf. FIG. 4 to 7) make an interlocking connection between the inner shaft 2 and the rotor 6 possible. Such an interlocking connection permits a tolerance compensation in the case of deviations of the axes of the inner shaft 2 and of the rotor 6.

Figure 1A:
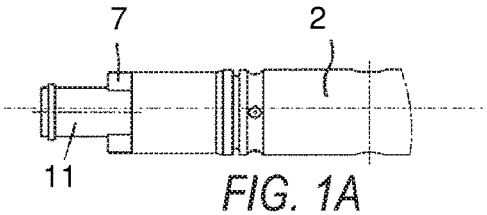
FIGS. 1A and 1B different views onto an inner shaft of an adjustable camshaft according to the invention, FIG. 1C a sectional illustration through the camshaft according to the invention, FIG. 2 an inner shaft according to the invention, with a rotor, partially cut to illustrate a connection contour, FIG. 3 a sectional illustration through the camshaft according to the invention with connection contours configured in a dome-shaped manner, FIGS. 4A-4C different views onto an inner shaft with an Oldham coupling, FIG. 5 a sectional illustration through a camshaft according to the invention with Oldham coupling between rotor and inner shaft, FIG. 6 perspective view of an Oldham coupling, FIGS. 7A and 7B a sectional illustration through the adjustable camshaft in the region of an intermediate piece of an Oldham coupling, FIG. 8 a sectional illustration through the camshaft according to the invention with connection contours configured in a dome-shaped manner on an intermediate piece.
Figure 1B:
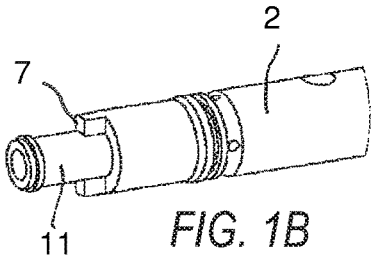
Figure 1C:
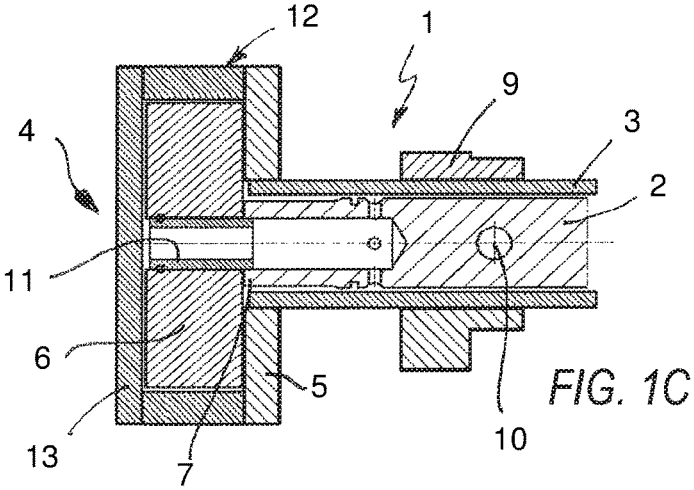

According to FIGS. 1*a* to 1*c*, the first connection contour 7 is configured as a tongue, whereas according to FIG. 2 the second connection contour 8 is configured as a groove configured in a complementary manner thereto, so that the first connection contour 7 and the second connection contour 8 together form a single-acting Oldham coupling, i.e. acting in one direction, wherein the tongue and the groove are aligned parallel to a pin 10 connecting a first cam 9 with the inner shaft 2. According to FIG. 1, in addition a sleeve 11 is arranged in the rotor 6 of the camshaft adjuster 4, which sleeve in particular can also undertake an oil-feeding function. The sleeve 11 is configured here as a separate component and is inserted into the inner shaft 2, whereby an initially separate processing of the inner shaft 2 without sleeve 11 is made possible, which presents itself to be distinctly simpler. The stator 5 has in addition a stator housing 12 with a cover 13. According to FIG. 1, the rotor 6 is arranged in a floating manner to the inner shaft 2 and is mounted by the stator 5 or respectively by the phase adjuster cover 13 and the sleeve 11. It is, of course, also conceivable that the rotor 6 in this arrangement is screwed by at least one screw against the inner shaft 2.

With the direct interlocking connection between the inner shaft 2 and the rotor 6 of the camshaft adjuster 4, shown according to FIGS. 1 to 3, a tolerance compensation is possible via a tongue-and-groove principle, similar to a single-acting Oldham coupling. Here, however, only a fault in an axial transverse direction can be compensated, wherein in this case the groove 8 is preferably aligned parallel to the axial direction of the pin 10, in order to be able to compensate the faults expected in this direction.

The camshaft 1 according to FIG. 3 shows, furthermore, a first connection contour 7 and a second connection contour 8, which are both configured in a dome-shaped manner, i.e. in the shape of a surface of a sphere, and engage into one another. Hereby, not only is a parallel misalignment between the axis of the inner shaft 2 and the axis of the rotor 6 to be compensated, but also an angular deviation between these two axes.

Observing FIG. 3 and FIG. 5, it can be seen that the rotor 6 is screwed to the inner shaft 2 via a screw 14, wherein an oil channel 15 runs in the screw 14, via which an oil feed is made possible from the inner shaft 2 via the screw 14 to the rotor 6.

Observing the embodiment of the camshaft 1 according to the invention, shown according to FIGS. 4 to 7, an Oldham coupling (cross coupling) can be seen here, in which between the inner shaft 2 and the rotor 6 an intermediate piece 16 is arranged, which is configured such that it forms the previously mentioned Oldham coupling with the first and second connection contour 7, 8. Such an Oldham coupling makes possible the compensation of a misalignment between two axes, here between the axis of the rotor 6 and the axis of the inner shaft 2. The intermediate piece 16 also has to connection contours 17, 18, wherein the connection contour 17 cooperates with the first connection contour 7 on the inner shaft 2 and the connection contour 18 cooperates with the second connection contour 8 on the rotor 6. The connection contours 7 and 17 are orthogonal here to the connection contours 8 and 18, whereby the tolerance compensation of the axis deviation is made possible.

Observing FIG. 5, it can be seen that the rotor 6 is screwed to the inner shaft 2 via the screw 14 and via the intermediate piece 16, i.e. is braced securely against these, whereby a floating mounting of the rotor 6 in the stator housing 12 is made possible. An axial mounting of the inner shaft 2 is of course necessary for this. If the rotor 6 is to be screwed with tolerance compensation against the inner shaft 2, the rotor 6 can of course also undertake the axial mounting of the inner shaft 2. The inner shaft 2 is always mounted radially via the pins 10 and the cams 9 pinned therewith. Reference S in FIG. 5 designates a possible play between the rotor 6 and the stator housing 12 or respectively the stator 5 and/or the screw 14.

In order to additionally also be able to compensate an angular misalignment between the axis of the rotor 6 and the axis of the inner shaft 2, the connection contours 17, 18 on the intermediate piece 16 and/or the first connection contour 7 and/or the second connection contour 8 can be configured as a rounded tongue or as a rounded-out groove. Furthermore, it is conceivable that at least one connection contour 17, 18, configured as a rounded tongue, has a plane face 19 on the tongue head, whereby even in the case of screwed-together components, the intermediate piece 16 still has a little "air/play", in order to make possible a tolerance compensation. In order, furthermore, to also make possible the damping effect and an additional tolerance compensation, at least one of the connection contours 7, 8, 17, 18 is coated, in particular with an elastomer material.

Figure 8:
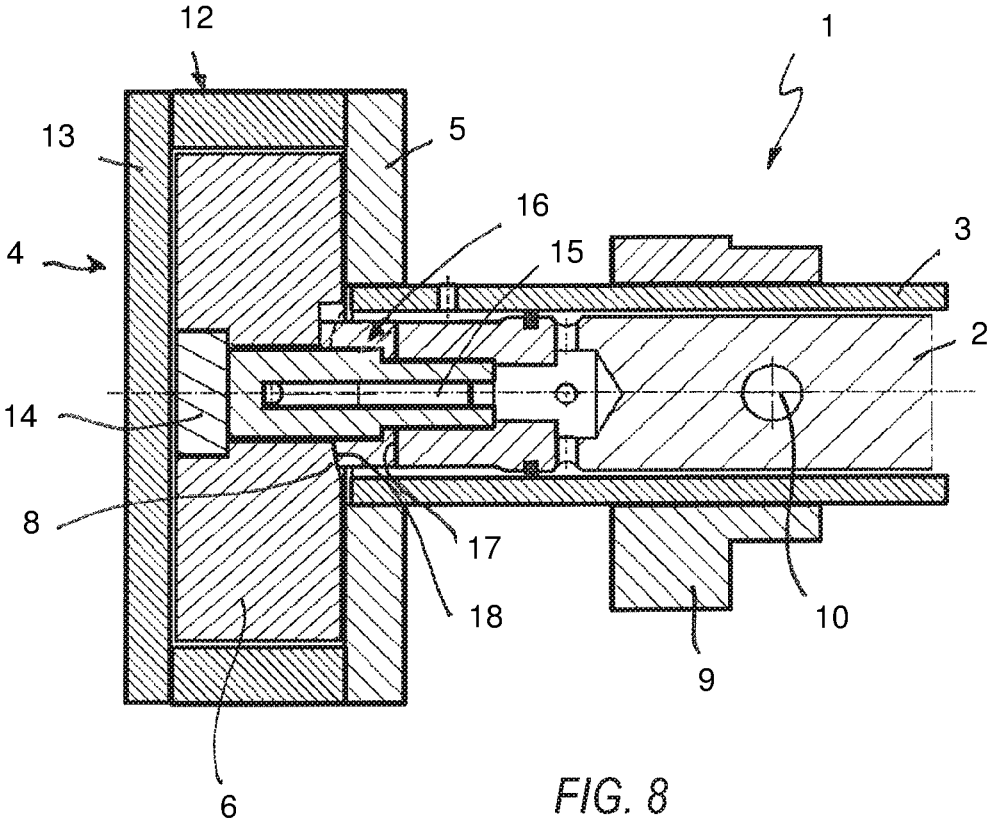

The camshaft 1 according to FIG. 8 shows a first connection contour 7 and a second connection contour 8, of which only the second connection contour 8 is configured in a dome-shaped manner and cooperates with a connection contour 18 of the intermediate piece 16 likewise configured in a dome-shaped manner. On the opposite side, the connection contour 17 is not configured in a dome-shaped manner, but it could be.

With the camshaft 1 according to the invention in particular a maximum tolerance compensation and a maximum torque transmission are possible owing to the interlocking connection.

The invention claimed is:

1. An adjustable camshaft comprising:

an inner shaft and an outer shaft arranged coaxially thereto;

a camshaft adjuster having a stator connected to the outer shaft in a torque-proof manner, and a rotor connected to the inner shaft; and an integral first connection contour provided at an end of the inner shaft, and an integral second connection contour complementary to the integral first connection contour and provided on the rotor, the integral first connection contour and the integral second connection contour directly or indirectly enabling an interlocking connection between the inner shaft and the rotor.

2. The camshaft according to claim 1, wherein the integral first connection contour is configured as a tongue, and the integral second connection contour is configured as a groove configured in a complementary manner thereto, so that the integral first connection contour and the integral second connection contour together form a single-acting Oldham coupling, wherein the tongue and the groove are aligned parallel to a pin connecting a first cam with the inner shaft.

3. The camshaft according to claim 2, wherein at least one of the integral first connection contour and the integral second connection contour is configured so as to be dome-shaped.

4. The camshaft according to claim 2, further comprising a screw connecting the rotor with the inner shaft, the screw having an oil channel, via which oil is feedable from the inner shaft to the rotor via the screw.

5. The camshaft according to claim 1, wherein at least one of the integral first connection contour and the integral second connection contour is configured so as to be dome-shaped.

6. The camshaft according to claim 5, further comprising a screw connecting the rotor with the inner shaft, the screw having an oil channel, via which oil is feedable from the inner shaft to the rotor via the screw.

7. The camshaft according to claim 1, further comprising a screw connecting the rotor with the inner shaft, the screw having an oil channel, via which oil is feedable from the inner shaft to the rotor via the screw.

8. The camshaft according to claim 1, further comprising an intermediate piece arranged between the inner shaft and the rotor, and which, via corresponding connection contours, forms an Oldham coupling together with the integral first connection contour and the integral second connection contour on the inner shaft and the rotor.

9. The camshaft according to claim 8, wherein at least one of: (i) the corresponding connection contours on the intermediate piece, (ii) the integral first connection contour, and (iii) the integral second connection contour is configured as one of a rounded tongue or a rounded-out groove.

10. The camshaft according to claim 9, wherein at least one of a first axial separation face between the intermediate piece and the rotor and a second axial separation face between the intermediate piece and the inner shaft is configured so as to be dome-shaped.

11. The camshaft according to claim 10, wherein at least one of (i) the corresponding connection contours on the intermediate piece, (ii) the integral first connection contour, and (iii) the integral second connection contour is configured as a rounded tongue having a plane face at a tongue head.

12. The camshaft according to claim 9, wherein at least one of: (i) the corresponding connection contours on the intermediate piece, (ii) the integral first connection contour, and (iii) the integral second connection contour is configured as a rounded tongue having a plane face at a tongue head.

13. The camshaft according to claim 8, wherein at least one of: (i) the corresponding connection contours on the intermediate piece, (ii) the integral first connection contour, and (iii) the integral second connection contour is coated with an elastomer material.

14. The camshaft according to claim 8, wherein one of:

the rotor is connected with the inner shaft via a press fit, or the rotor is arranged with axial play to the inner shaft.

15. The camshaft according to claim 1, wherein one of:

the rotor is connected with the inner shaft via a press fit, or the rotor is arranged with axial play to the inner shaft.

16. The camshaft according to claim 1, wherein at least one of the integral first connection contour and the integral second connection contour is coated with an elastomer material.

17. An adjustable camshaft comprising:

an inner shaft and an outer shaft arranged coaxially thereto;

a camshaft adjuster having a stator connected to the outer shaft in a torque-proof manner, and a rotor connected to the inner shaft;

an integral first connection contour provided at an end of the inner shaft, and an integral second connection contour complementary to the first connection contour and provided on the rotor, the integral first connection contour and the integral second connection contour directly or indirectly enabling an interlocking connection between the inner shaft and the rotor; and an intermediate piece arranged between the inner shaft and the rotor, and which, via corresponding connection contours, forms an Oldham coupling together with the integral first connection contour and the integral second connection contour on the inner shaft and the rotor.

18. The camshaft according to claim 17, wherein at least one of (i) the corresponding connection contours on the intermediate piece, (ii) the integral first connection contour, and (iii) the integral second connection contour is configured as one of a rounded tongue or a rounded-out groove.

19. The camshaft according to claim 18, wherein at least one of a first axial separation face between the intermediate piece and the rotor and a second axial separation face between the intermediate piece and the inner shaft is configured so as to be dome-shaped.

20. The camshaft according to claim 18, wherein at least one of: (i) the corresponding connection contours on the intermediate piece, (ii) the integral first connection contour, and (iii) the integral second connection contour is configured as a rounded tongue having a plane face at a tongue head.

* * * * *